United States Patent [19]

Naito et al.

[11] Patent Number: 4,930,761

[45] Date of Patent: Jun. 5, 1990

[54] CONTROL METHOD FOR SORTER WITH STAPLER

[75] Inventors: Masataka Naito; Takeshi Honjo, both of Kawasaki; Kenji Kobayashi, Tokyo; Jun Saito; Hironori Shido, both of Kawasaki; Masakazu Hiroi, Yokohama, all of Japan

[73] Assignee: Canon Kabushiki Kaisha, Tokyo, Japan

[21] Appl. No.: 225,803

[22] Filed: Jul. 29, 1988

[30] Foreign Application Priority Data

Jul. 30, 1987 [JP] Japan ..... 62-191935
Jul. 30, 1987 [JP] Japan ..... 62-191937
Aug. 7, 1987 [JP] Japan ..... 62-197786

[51] Int. Cl.[5] ..... B42B 2/00
[52] U.S. Cl. ..... 270/53; 270/58
[58] Field of Search ..... 270/37, 52, 53, 58; 271/287, 288, 289, 290, 292

[56] References Cited

U.S. PATENT DOCUMENTS 216,118 7/1988 Uto et al. .
226,061 7/1988 Shido et al. .
226,064 7/1988 Shido et al. .
3,685,712 8/1972 Turner et al. .
3,884,408 5/1975 Leiter et al. .
3,994,427 11/1976 Ganatsiou .
4,134,672 1/1979 Burlew et al. .
4,281,920 8/1981 Cross .
4,295,733 10/1981 Janssen et al. .
4,376,529 3/1983 George et al. .
4,382,592 5/1983 Harding et al. .
4,497,478 2/1985 Reschenhofer et al. .
4,566,782 1/1986 Britt et al. .
4,627,706 12/1986 Takahashi ..... 271/292
4,681,310 7/1987 Cooper .
4,684,241 8/1987 Acquaviva .
4,687,191 8/1987 Stemmle ..... 270/53
4,709,915 12/1987 Ishikawa ..... 271/288
4,762,312 8/1988 Ushiragata .
4,787,616 11/1988 Sasaki ..... 271/289
4,983,550 4/1978 Pal .

FOREIGN PATENT DOCUMENTS 009925 12/1985 European Pat. Off. .
119069 5/1987 Japan ..... 270/53
2168037 12/1984 United Kingdom .
2126997 1/1986 United Kingdom .

OTHER PUBLICATIONS

*Xerox Disclosure Journal,* "Sorter with Dual Purpose Tray" by D. Tates, vol. 1 No. 4, Apr. 1976, p. 61.

*Primary Examiner*—Robert E. Garrett
*Assistant Examiner*—Therese M. Newholm
*Attorney, Agent, or Firm*—Fitzpatrick, Cella, Harper & Scinto

[57] ABSTRACT

A method of controlling a sheet sorter wherein the sheet sorter includes a plurality of bins for accommodating sheets, the bins being arranged in a vertical direction, a first sheet discharging device for discharging sheets not to be sorted, second sheet discharging device, disposed with a vertical interval from the first sheet discharging device, for discharging sheets to be sorted, bin moving device for moving substantially vertically the bins and stapler device for stapling the sheets, the method includes providing the stapler adjacent to the first sheet discharging device; accommodating the sheets on the plurality of bins of sequentially opposing the bins to the second sheet discharging device, and stapling the sheets on the bins by the stapler, when a sorting mode and a stapling mode are selected; discharging the sheets by the first discharging device and accommodating them on a the bin when a non-sorting mode and non-stapling mode are selected; and discharging the sheet by the second discharging device and accommodating them on the bin, and stapling them, when the non-sorting mode and the stapling mode is selected.

5 Claims, 18 Drawing Sheets

CONTROL METHOD FOR SORTER WITH STAPLER

FIELD OF THE INVENTION AND RELATED ART

The present invention relates to a sheet sorter coupled with an image forming apparatus such as a copying machine and printer to sort and stack sheets such as copies and prints discharged from the image forming apparatus, more particularly to a control method for the sheet sorter provided with a number of movable bins for receiving the sheets and provided with a stapler at a sheet discharging portion to staple the sheets. A sheet sorter which will hereinafter be called simply "sorter" is known which is provided with a number of movable bins and provided with two discharging portions for discharging the sheets to those bins, wherein the sheets are discharged through the different discharging portions between when the sheets are to be sorted (sort mode) and when the sheets are not sorted (non-sort mode).

Also, a limitless sorter is known wherein the sheets can be sorted and accommodated without limitation by the number of bins, which will hereinafter be called "limitless sorter", and wherein set of sheets are stapled in the respective bins. For example, U.S. Pat. No. 3,884,408 discloses horizontal limitless sorter of a stationary bin type wherein a carriage for carrying a stapler is movable to the respective bins, and the stapler is rotated away from the carriage to staple a stack of sheets. Japanese Laid-Open Patent Application No. 220053/1983 discloses a limitless sorter wherein a stapler block moves substantially vertically, expands the space between adjacent bins and inserts a stapling head into the space to staple the stack of sheets. U.S. Pat. No. 4,295,733 discloses a limitless sorter wherein a set of sheets are gripped by a gripper and is transported to a stapler by which it is stapled. In the conventional sorters with stapler, the stapler is generally disposed adjacent the discharging portion for discharging the sheets in non-sort mode. Therefore, the stapling operation in non-sort mode is not considered.

SUMMARY OF THE INVENTION

Accordingly, it is a principal object of the present invention to provide a control method for a sorter with a stapler wherein sheets can be stapled in either of sort-mode and non-sort mode.

In order to achieve this object, according to the present invention, there is provided a control method for the sorter with the stapler, by which the stapler is disposed adjacent to a discharge outlet through which the sheets are discharged in sort mode, wherein the bins are sequentially positioned to a position opposed to the stapler, and the sorted sheets are stapled; when the non-sort mode and non-staple mode are selected, the sheets are discharged through a discharge outlet for the non-sorted sheets; and when non-sort mode and a staple mode is selected, the sheets are discharged to the discharge outlet for the sorted sheets to allow the sheets to be stapled by the same stapler.

Therefore, according to this embodiment, when the staple mode is selected, the sheet transportation direction is switched to discharge the sheets through the discharging means for the sorted sheet, irrespective of the selection of the sorting mode, by which the sheets can be stapled by the stapler. When the non-sorted sheets are to be stapled, the stapling operation can be performed speedily. More particularly, if the non-sorted sheets are discharged by another discharging means for the non-sorted sheets, it is required that the bin having received the sheets is moved to a position where the stapler is provided, but according to this invention, the time required for this can be eliminated, and in addition, since it is not necessary to move the bin, the aligned sheets are not disturbed by the movement of bins.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 9A, 9B, 9C and 9D illustrate movement of bins by a lead cam, wherein FIG. 9A is a view seen in the direction indicated by an arrow V(a) in FIG. 10; FIG. 9B is a view seen in the direction indicated by an arrow V(b) in FIG. 10; FIG. 9C is a schematic drawing of FIG. 9A; and FIG. 9D is a schematic drawing of FIG. 9B.

DESCRIPTION OF THE PREFERRED EMBODIMENTS

Figure 2:
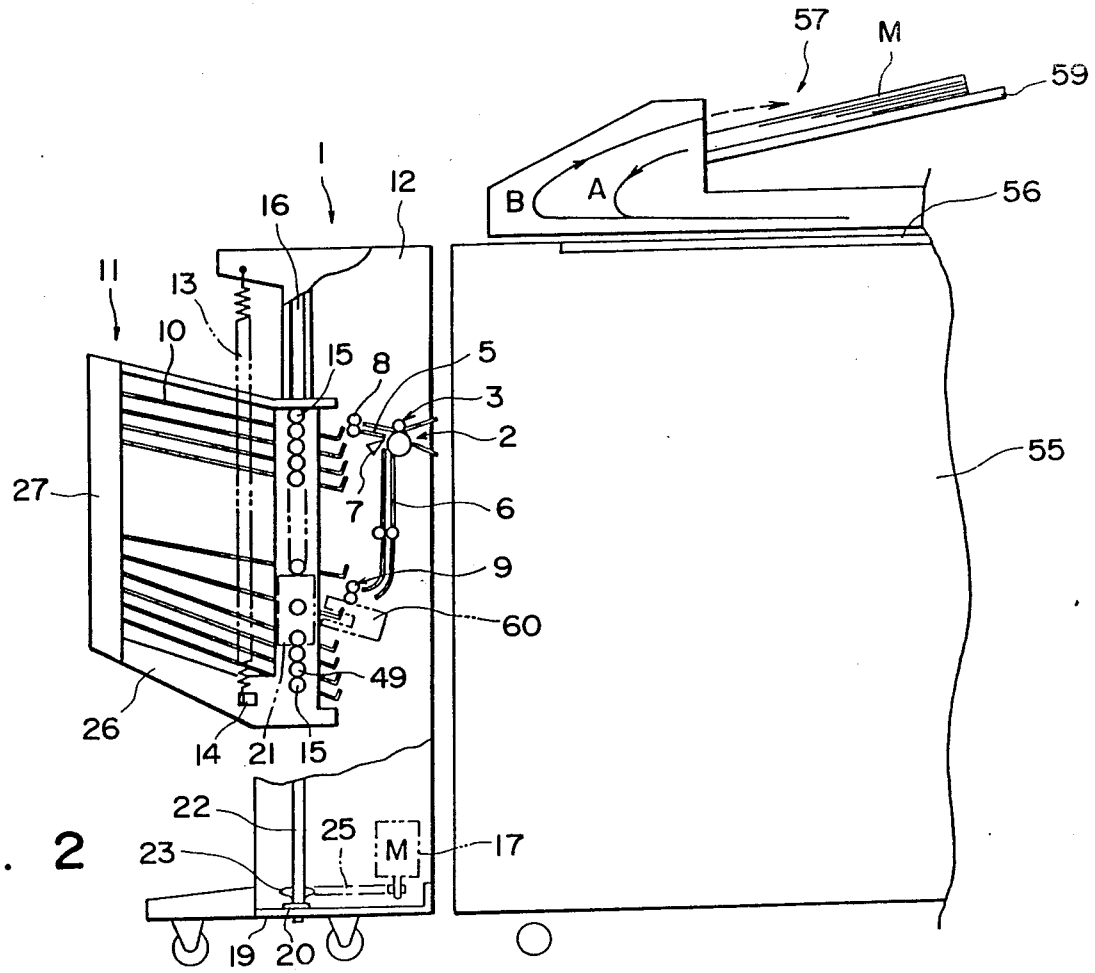
FIG. 2 is a front view of an image forming apparatus provided with a sheet sorter according to the present invention.

Referring to FIG. 2, there is shown a sorter 1 according to an embodiment of the present invention. The sorter 1 is coupled with a copying machine 55 and is effective to sort and accommodate sheets S discharged from the copying machine 55. The copying machine 55 has a platen 56 for supporting thereon an original M, and the copying machine 55 is provided with an automatic document or original feeder 57 for transporting the original N onto the platen 56. The automatic document feeder 57 has an original tray 59 for stacking thereon the originals M, a transportation passage A for transporting the original M from the tray 59 to the platen 56 and a discharge passage B for discharging the original M from the platen 56 to the original tray 59.

Figure 3:
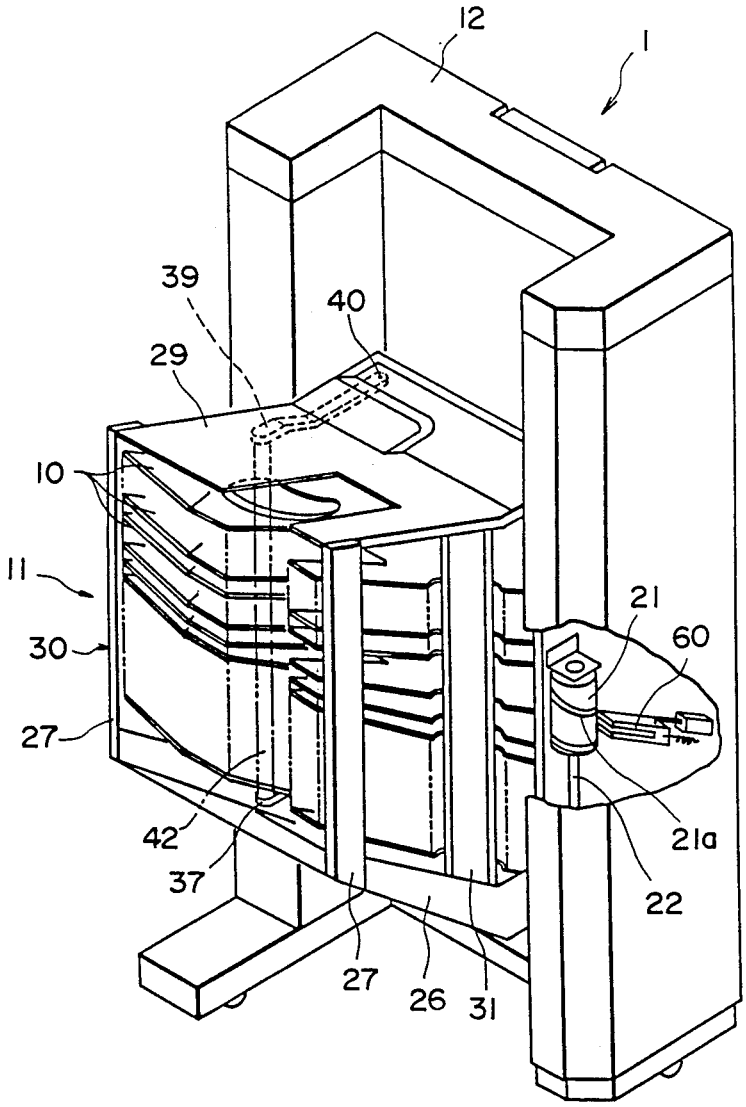
FIG. 3 is a perspective view of the sorter according to this embodiment.

As shown in FIGS. 2 and 3, the sorter 1 comprises a main assembly 12 and a bin unit 11. The main assembly 12 is provided with inlet roller couple 3 adjacent to a sheet inlet 2. Downstream of the roller couple 3, a flapper 7 for switching the sheet transportation direction is provided between a sheet passage 9 and a sheet passage 6. One 5 of the sheet passages extends substantially horizontally, and a sheet discharging roller couple 8 is disposed downstream thereof. The other one 6 extends downwardly, and a sheet discharging roller couple 9 is disposed downstream thereof. In the neighborhood of the discharging roller couple 9, a stapler 60 is disposed. Downstream of the discharging roller couples 8 and 9, a bin unit 11 provided with a number of bins 10 is supported for vertical movement. A spring 14 having one end fixed to the main assembly 12 is engaged to a hook 14 so as to support the weight of the bin unit. At upper and lower portions of the base side of the bin unit 11, guide rollers 15 and 15 are rotatably supported. The rollers 15 and 15 are engaged with a guiding slot 16, in which the rollers 15 and 15 roll to guide the bin unit 11. The main assembly 12 has a driving motor 17 mounted thereto and a thrust bearing 20 on the base plate 19. The thrust bearing 20 bears the thrust load of the rotational shaft 22. The shaft 22 is rotatably supported by the bearing 20 at its lower end, and rotatably supported by an unshown bearing at an upper end. To the rotational shaft 22, a lead cam 21 and a sprocket 23 are fixed. Between the sprocket 23 and the shaft of the motor 17, a chain 25 is trained, by which the rotation of the motor 17 is transmitted to the rotational shaft 21 through the chain 25. The bin unit 11 includes a main assembly 30 including a bottom frame 26 having an inclined portion and a horizontal portion, vertical frames 27 and 27 provided at front and rear sides at an end remote from the main apparatus and a cover 29 supported by the frames 27 and 27. At a front side of the unit 30, an alignment reference plate 31 is provided for abutment with the sheet received thereby. At a rear part of the base end (which is near the image forming apparatus) of the frame 26, a lower arm 37 is rotatably supported, the arm 37 being driven by an unshown driving means. An arm 39 is fixed to a shaft 40 rotatably supported on the cover 2 at a position opposite from the arm 39. Between the rotational center of the arm 39 and the rotational center of the arm 39, a shaft 41 is extended so that the arms 37 and 39 swing by rotation of the shaft 41. Between a free end of the arm 37 and the free end of the arm 39, an alignment rod 42 is extended, so that the alignment rod 42 swings by the driving means.

Figure 4:
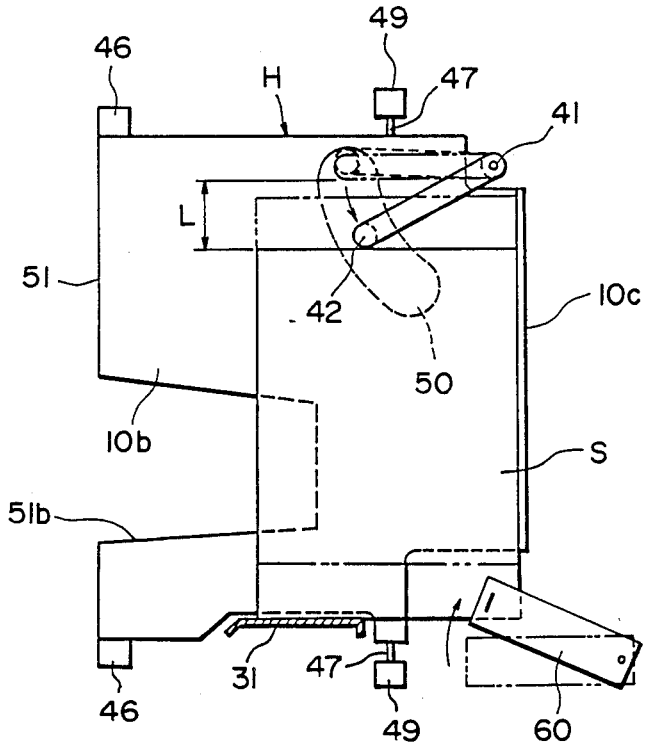
FIG. 4 is a top plan view of the sorter of this embodiment.

As shown in FIG. 4, the bin 10 has engaging plate 46 at front and rear sides of remote end thereof. By engagement of the engaging plate 46 with an unshown supporting plate disposed inside the frame 27, the bin is supported at its remote end. At the front and rear sides of the base end of the bin 10, supporting pin 47 are fixed to the bin 10, and rollers (trunnions) 49 are rotatably supported on the supporting bins 47. In the bin 10, an elongated slot 50 is formed which is away from the shaft 41 through a predetermined distance and has a length larger than the rotational distance of the alignment rod 42 and has a width sufficiently larger than the width or diameter of the alignment rod 42. The base end portion 10*c* of the bin 10 is perpendicular to a sheet receiving surface 10*b*. The bin 10 is inclined downwardly toward the main assembly 12. Due to the inclination, the sheet received thereby slides on the sheet receiving surface 10*b* so that the trailing edge of the sheet is abutted to the base portion 10*c*, whereby the sheet is aligned in the longitudinal direction. In the bin, the cut-away portion 51*b* is formed extending from the remote end of the bin body 51 to substantially the center of the sheet accommodating or receiving surface 10*b*. The cut-away portion 51*b* is effective to facilitate a small size sheet stacked on the sheet receiving surface 10*b* to be easily taken away.

Through the elongated slots 50 of the bins, the above-described alignment rod 42 is penetrated, wherein the alignment rod 42 swings through the elongated slots 50 to urge and align the sheets S to the alignment reference plate 31. The lead cam 21 has a helical groove having a width slightly larger than the diameter of the roller 49, and the groove 21*a* is engaged with the roller 49. By rotation of the lead cam 21, the roller 49 is movable substantially vertically along the groove 21*a* (FIG. 3).

Figure 1:
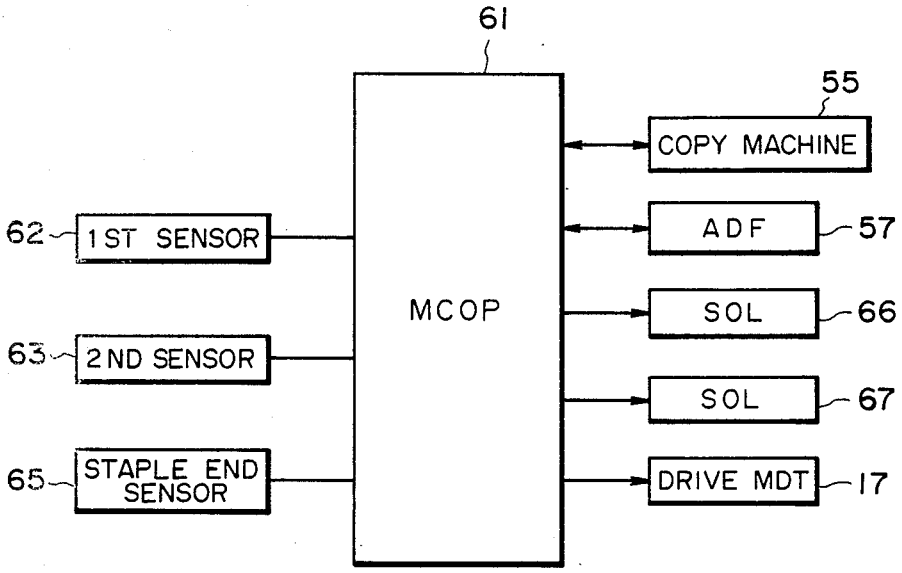
FIG. 1 is block diagram illustrating control means according to this invention.

Referring now FIG. 1, the sorter 1 is provided with a microcomputer 61 having an input port to which are connected a first sensor 62 for detecting the bin 10 located at the topmost position for receiving the sheet discharged by the discharging roller couple 9, a second sensor 63 for detecting the topmost bin 10 at a position for receiving the sheet discharged by the discharging roller couple 8, a staple completion sensor 65 for detecting completion of the stapling operation by the stapler 60 and the like. The microcomputer 61 has an output port to which are connected the driving motor 17, the solenoid 66 for driving the flapper 7 and a solenoid 67 for driving the stapler 60. The input and output port are connected with the copying machine 55 and with the automatic document feeder 57.

Figure 5A:
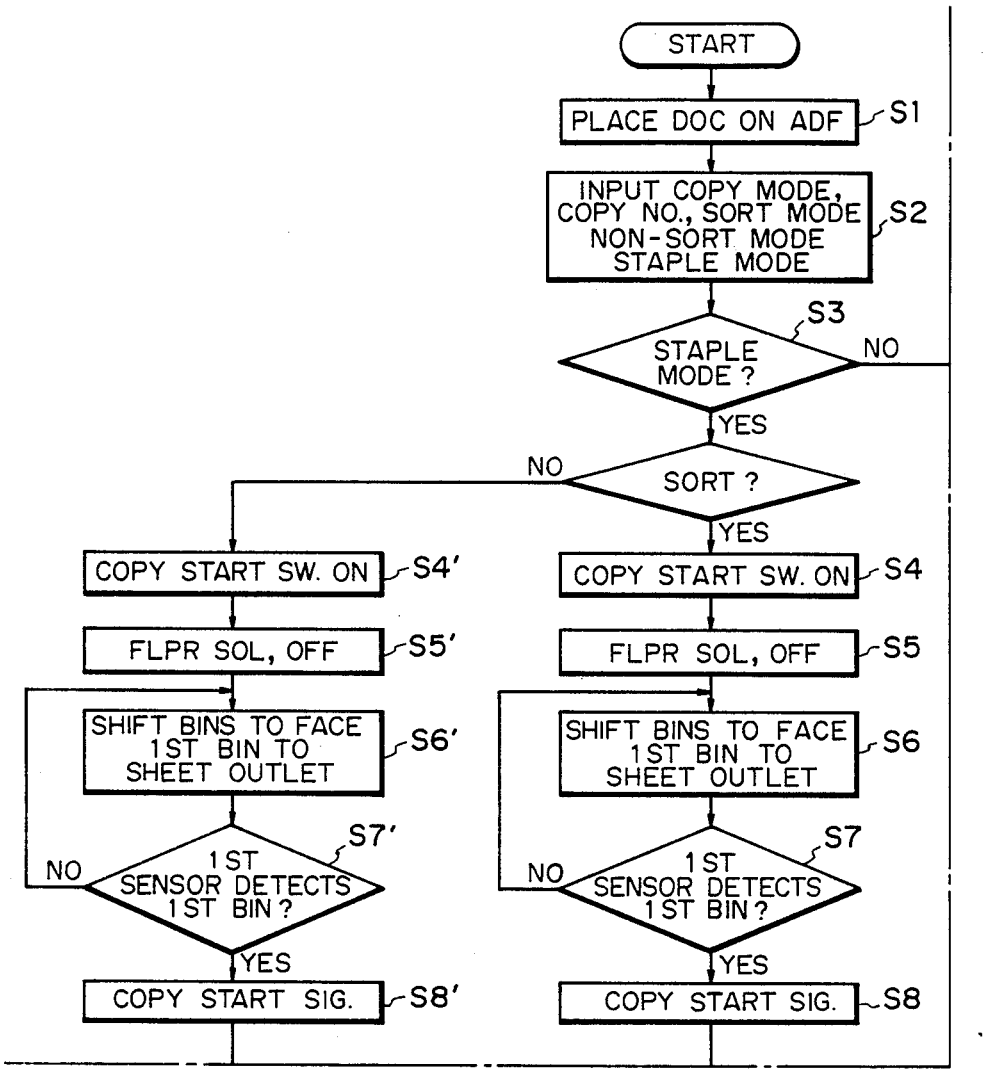
FIGS. 5, 5A, 5B, 5C, and 5D are flow charts illustrating operation of the apparatus according to this invention.
Figure 5B:
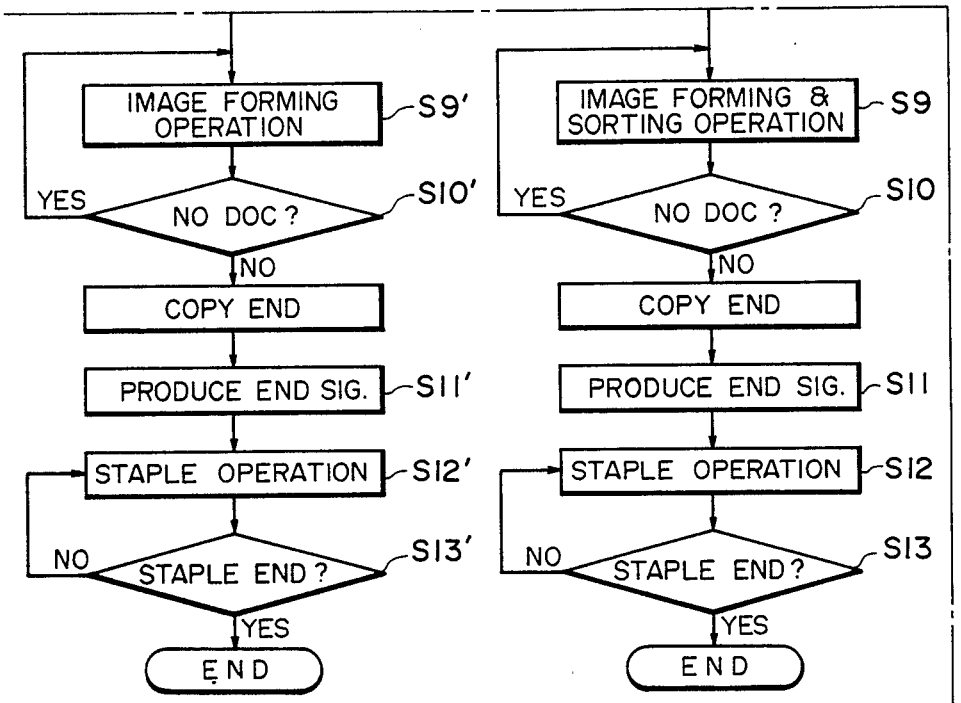
Figure 5C:
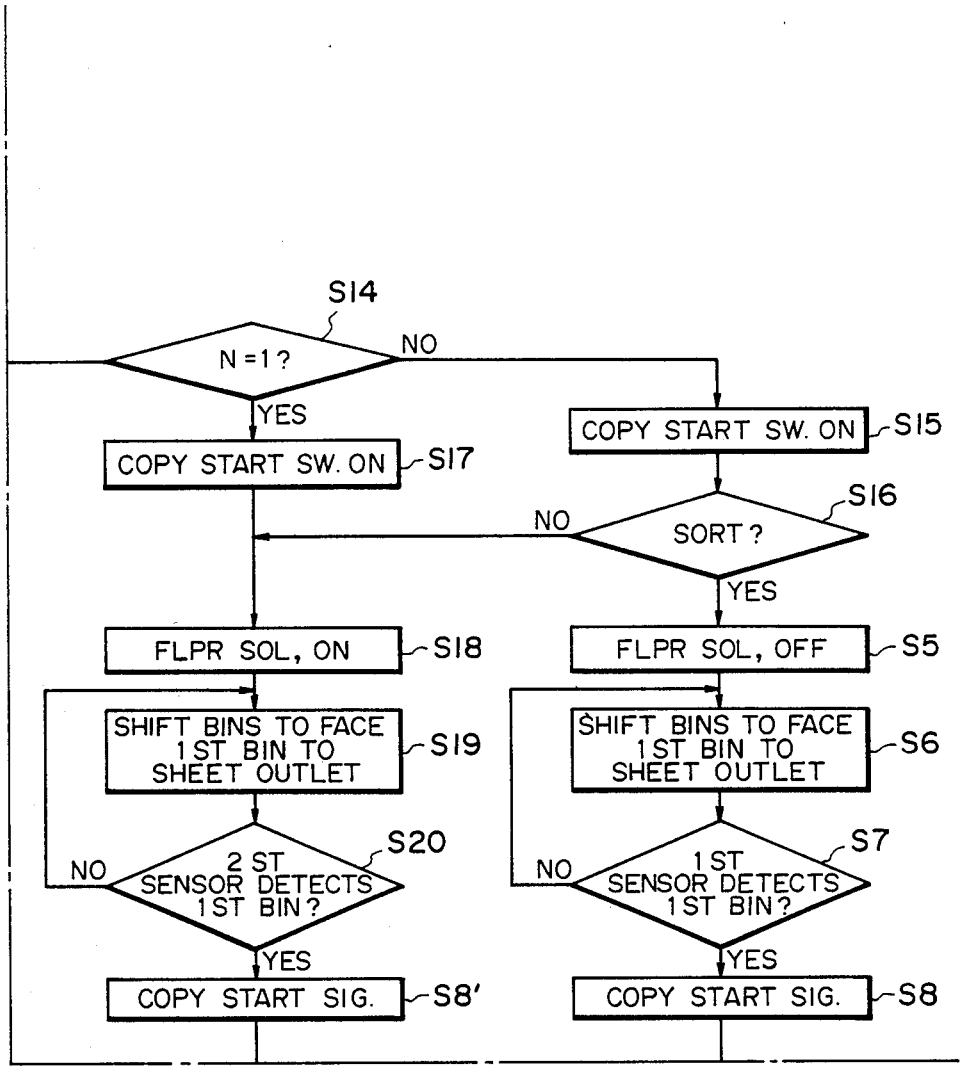
Figure 5D:
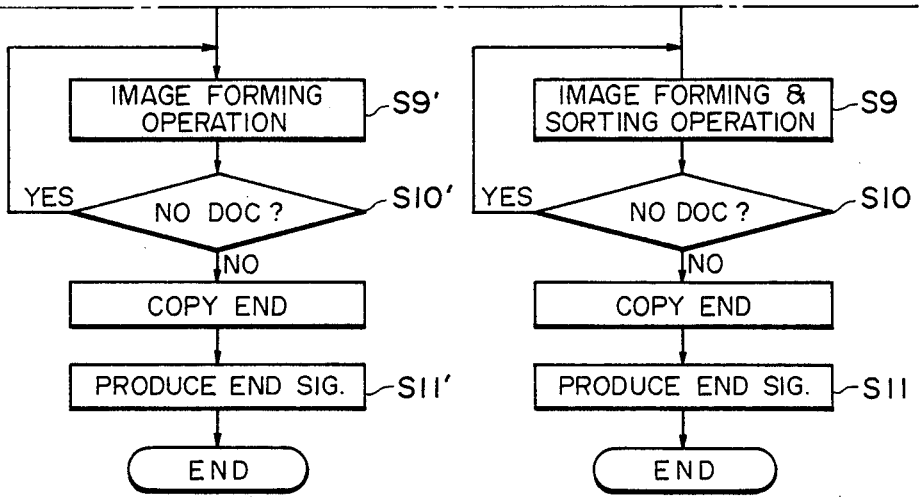
Figure 5:
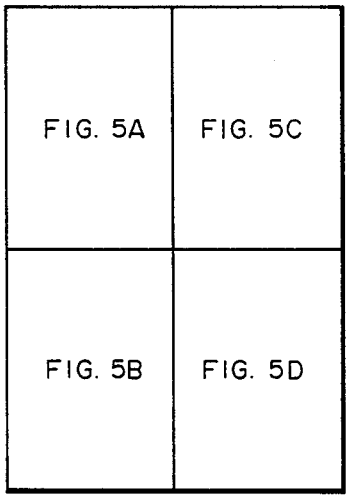

Referring to FIG. 5, the operation will be described.

An operator placed the originals M to be copied face down on the original tray 59 (S1), and inputs copy process mode, number of copies to be taken, sort mode and staple mode or the like on an operation panel of the copying machine (S2). The microcomputer 61 receives the signals from the operation panel and discriminates whether the stapling mode is selected or not (S3). When the stapling mode and sort mode are selected, the computer 61 deenergize the solenoid 66 to switch the flapper 7 to the passage 6 side (S5) upon depression of the copy start switch by the operator (S4). Then, the microcomputer 61 instructs the driving motor 17 to rotate the lead cam 21 until the topmost bin 10 reaches a position for receiving the sheets S discharged by the discharging roller couple 9 (FIG. 6) (S6). Then, the microcomputer 61 discriminates on the basis of the signal from the first sensor 62 whether the topmost bin 10 is detected by the first sensor 62 or not (S7). If so, a copy start signal is transmitted to various parts (S8). The automatic document feeder 57, receiving the signal, separates one by one the originals M stacked on the original tray 59 from the bottom, to feed the originals M one by one through the passage A. The original M is read by an unshown copy processing station of the copying machine 55, and after the image of the original is read, it is returned to the topmost of the originals M on the original tray 59 through the discharge passage B. Here, a partition lever (not shown) is inserted between the copied original M and the uncopied originals M on the tray 59 to prevent mixture. The copy process station having read the image of the original M copies the image on the sheet S fed from a sheet feeding station, and the sheet S is subjected to an image fixing operation by an image fixing device, and thereafter, it is discharged from the copying apparatus 55. The sheet S discharged from the copying apparatus 55 is directed into the main assembly 12 through the inlet 2 by an inlet roller couple 3, by which it is transported to the flapper 7. Then, the sheet S is guided to the sheet passage 6 by the flapper 7, and is discharged by the discharging roller couple 9 onto the topmost bin 10 of the bin unit having been moved downwardly. The sheet S discharged on the bin 10 is slid by the inclination of the bin to the base end so that it is contacted to the base portion 10*c*. However, the sheet is away from the alignment reference plate 31. The microcomputer 61 having received sheet size information from the copying machine 55 rotates by the driving means the alignment rod 42 from the home position H through a horizontal distance L to move the sheet S from the chain line position to the solid line position, whereby the front side of the sheet S is abutted to and aligned to the alignment reference plate 31 (S9) (FIG. 4). After a predetermined time elapses, the driving means is reversed, so that the alignment rod 42 is returned to the home position H. The microcomputer 61 responds to a signal from an unshown sensor and discriminates whether there is any original M on the original tray 59 (S10). If so, the similar operations are repeated to copy a next original on the next sheet S, and the sheet S is received and aligned on the second bin 10 having lifted by one stage. The similar operations are repeated until there becomes no original M on the original tray 59. When there becomes no uncopied original M on the original tray 59, the microcomputer 61 produces a copy completion signal (S11). The computer 61 drives the motor 17 to rotate the lead cam 21 so that the topmost bin 10 is moved to a stapling position, that is, the position where the sheet S discharged by the discharging roller couple 9 is received. When it is detected by the first sensor 62, the sheets S thereon is stapled by the stapler 60 (S12). The computer 61 rotates the lead cam 21 by the driving motor 17 to lift the bins 10 by one stage, and the sheets S accommodated on the second bin 10 moved to the stapling position are stapled. By the similar operations, the bins 10 are lifted stage by stage, to staple the sheets S on the bin 10 sequentially, until all the sheets S on all of the bins having received the sheets S are stapled (S13).

Figure 6:
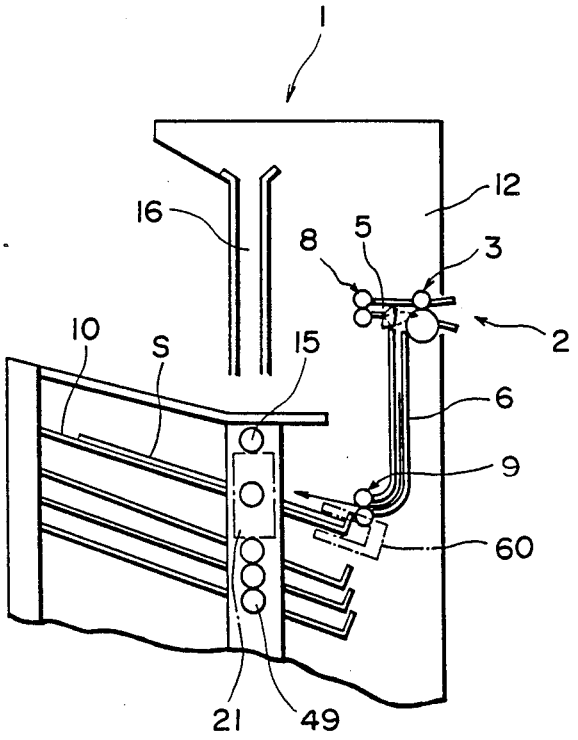
FIG. 6 is a front view of the sorter according to this invention.

When the stapling mode and the non-sort mode are discriminated as having been selected (S3), the computer 61 deenergize the solenoid 66 to switch the flapper 7 to the sheet passage 6 side (S5') upon depression of a copy start switch by the operator (S4'). Then, the microcomputer 61 instructs the driving motor 67 to rotate the lead cam 21 (S6') until the topmost bin 10 reaches a position for receiving the sheets S discharged by the discharging roller couple 9 (FIG. 6). The microcomputer 61 discriminates on the basis of the signal from the first sensor 61 whether the first sensor 62 detects the topmost bin 10 or not (S7'). If so, it transmits a copy start signal to various parts (S8'). The automatic document feeder 57 having received the signal, separates the originals M stacked on the original tray 59 one by one from the bottom, and transports it onto the platen 56 through the passage A. Then, the original M is read by a copy process station (not shown) of the copying machine 55, and after it is read, it is returned to the topmost of the originals M stacked on the original tray 59 through the sheet passage B. An unshown partition lever is inserted between the original M and uncopied originals M on the original tray 59 to prevent mixture. The copy process station having read the image of the original M copies the image on the sheet S fed from a sheet feeding station, and the sheet S is subjected to an image fixing operation and is discharged from the copying machine 55. The sheet S discharged from the copying machine 55 is introduced into the main assembly 12 through the inlet 2 by the inlet roller couple 3, by which it is transported to the flapper 7. Then, the sheet S is guided to the passage 6 by the flapper 7 and is discharged by the discharging roller couple 9 onto the topmost bin 10 of the bin unit 11 having moved downwardly. The sheet S discharged on the bin 10 slides on the bin 10 by the inclination of the bin 10 to be abutted to the base portion 10*c*. However, the sheet is away from the alignment reference member 31. The microcomputer having received sheet size information from the copying machine 55, swings the alignment rod 42 by the driving means from the home position H through a horizontal distance L to move the sheet S from the chain line position to the solid line position, so that the front side edge of the sheet S is abutted to and aligned to the alignment reference plate 31 (S9') (FIG. 4). After a predetermined period of time elapses, the driving means is reversed to return the alignment rod 42 to the home position H. The microcomputer 61 discriminates on the signal from an unshown sensor whether there is any uncopied original on the original tray 59 or not (S10'). If so, by the similar operation, the image of the original M is copied on the sheet S, and the sheet S is aligned and accommodated on the bin 10. Similarly, the same operations are repeated until there is no uncopied original on the original tray 59. When there is no uncopied original M on the original tray 59, the microcomputer 61 produces a copy process completion signal (S11'). The computer 61 actuates the stapler 60 to staple the sheet S on the bin 10 by the stapler 60 (S12').

If the microcomputer 61 discriminates that the stapling mode is not selected (S3), the computer 61 discriminates whether or not the number of copies to be taken is single or not. If not single, the microcomputer 61 discriminates whether the sort mode is selected or not (S16) upon actuation of the copy start switch (S15). If the sort mode is selected, the microcomputer 61 executes the operation from the step S5 to the step S11 to complete the sheet sorting operation.

If the number of the copies to be taken N is discriminated as single (S14), the microcomputer 61 actuates the solenoid 66 to switch the flapper 7 to the passage 5 side (S18) upon actuation of the copy start switch (S17). Further, the computer 61 instruct to drive the driving motor 17 to rotate the lead cam until the topmost bin 10 reaches a position for receiving the sheet S discharged by the discharging roller couple 8 (S19). The microcomputer 61 discriminates on the signal from the second sensor 63 whether the second sensor 63 detects the topmost bin 10 or not (S29). If so, the steps from S8 to S11 are performed only for the topmost bin 10, and the operation is completed. In this embodiment, the discharging roller couple 8 is exclusively for the non-sort mode. But, it is possible that it is for unfixed size sheets such as those manually fed, post cards, OHP sheets or other special sheets, by which they are prevented from erroneously stapled.

Figure 7:
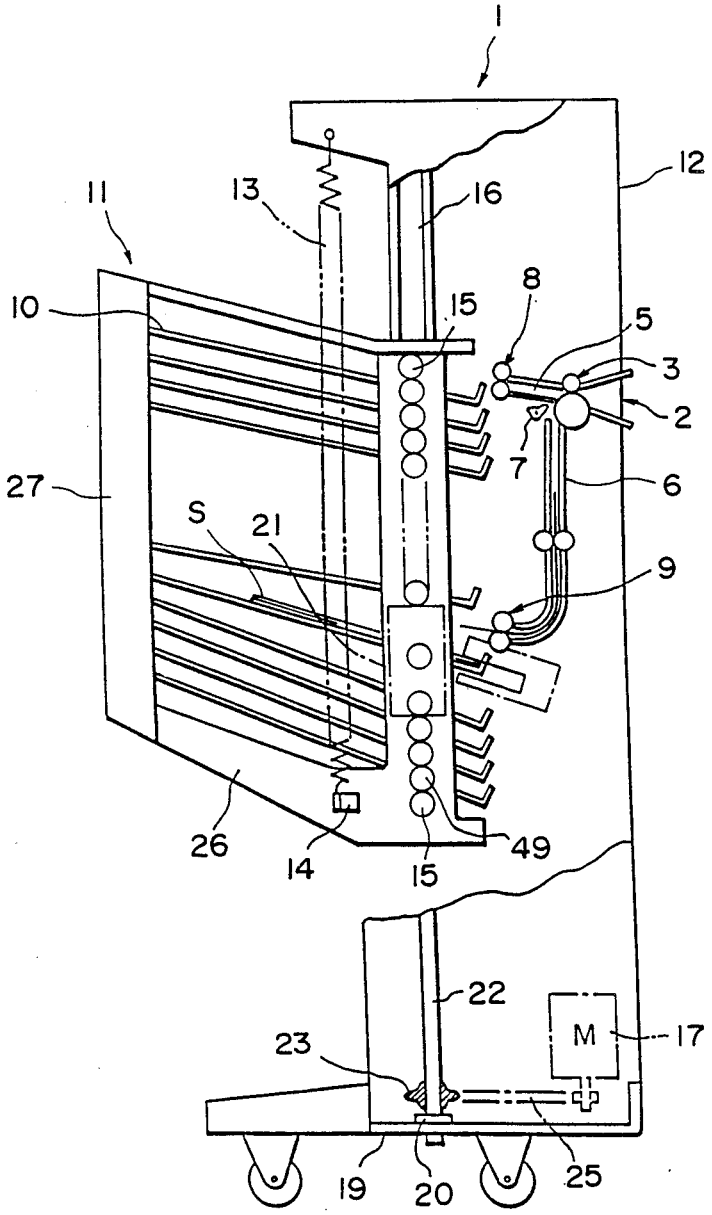
FIG. 7 is a front view of the apparatus according to another embodiment of the present invention.

In the foregoing embodiment, when the stapling mode and the non-sort mode are selected, the topmost bin 10 is moved to a position for receiving the sheets S discharged by the discharging roller couple 9. However, it is possible that, as shown in FIG. 7, when one set of sheets is stapled, the sheets are received by the bin 10 which is currently at the position for receiving the sheets discharged by the discharging roller couple 9, and then, they are stapled. By doing so, the time required for the movement of the bin can be saved.

In the foregoing embodiment, the stapling operation is started after all the sheets S are sorted and received by the bins, but the sheets S may be stapled each time the last sheet S is discharged on the bin.

Figure 8:
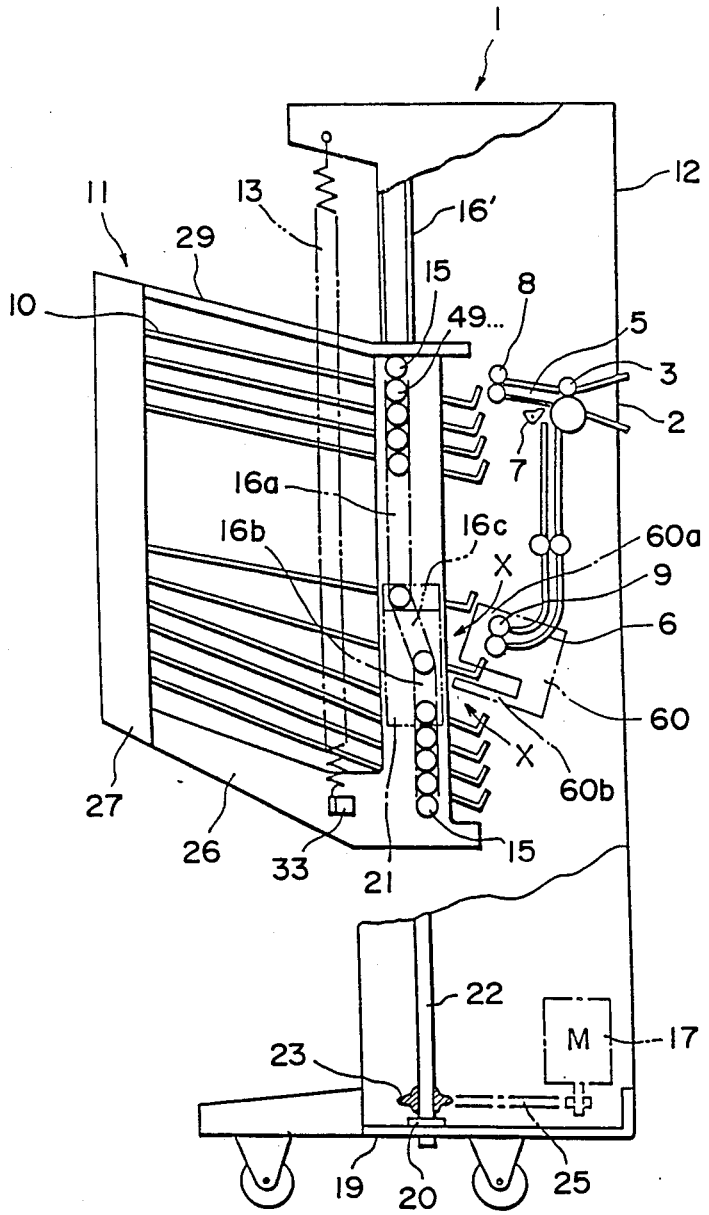
FIG. 8 is a side view of a sorter according to another embodiment of the present invention.
Figure 9A:
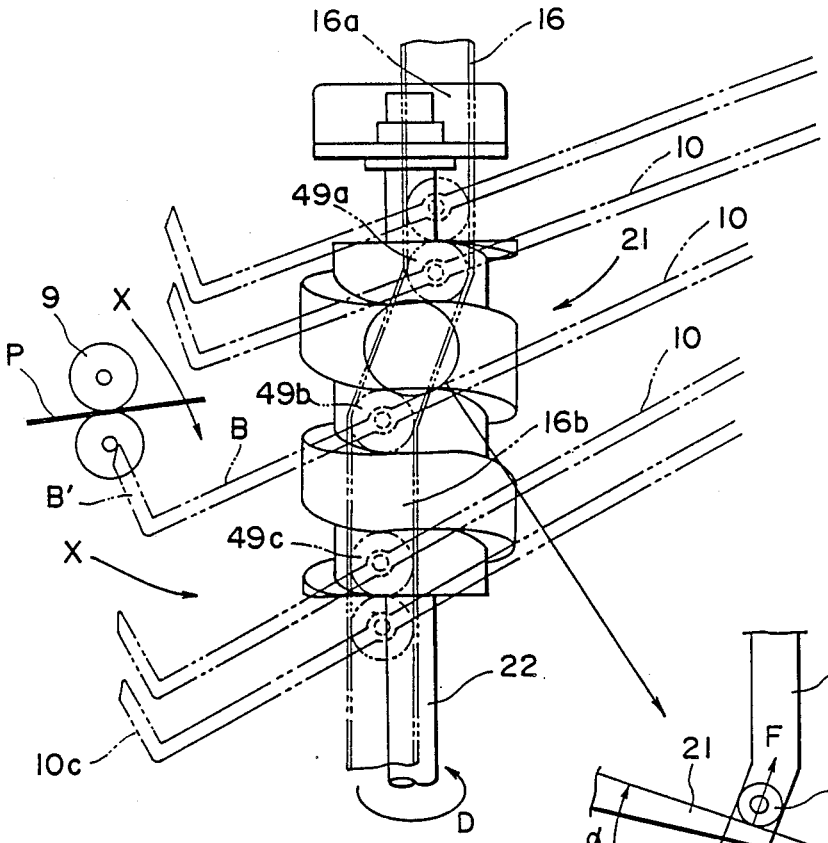
Figure 9C:
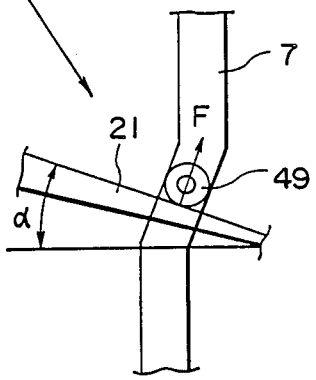

Referring to FIGS. 8 and 9, another embodiment of the present invention will be described.

The lead cams 21 and 21 are disposed faced to a lower discharging roller couple 9 disposed substantially at the center of the sorter assembly 6. The trunnion 49 of the bin B moving toward a position opposed to the lower discharging roller couple 9 is carried on the helical cam surface to move it along the guide rail 16' so as to form an expanded space X at a position where the bin is opposed to the lower discharging roller couple 9, the expanded space being larger than the intervals between the other adjacent bins.

Figures 9B, 9D:
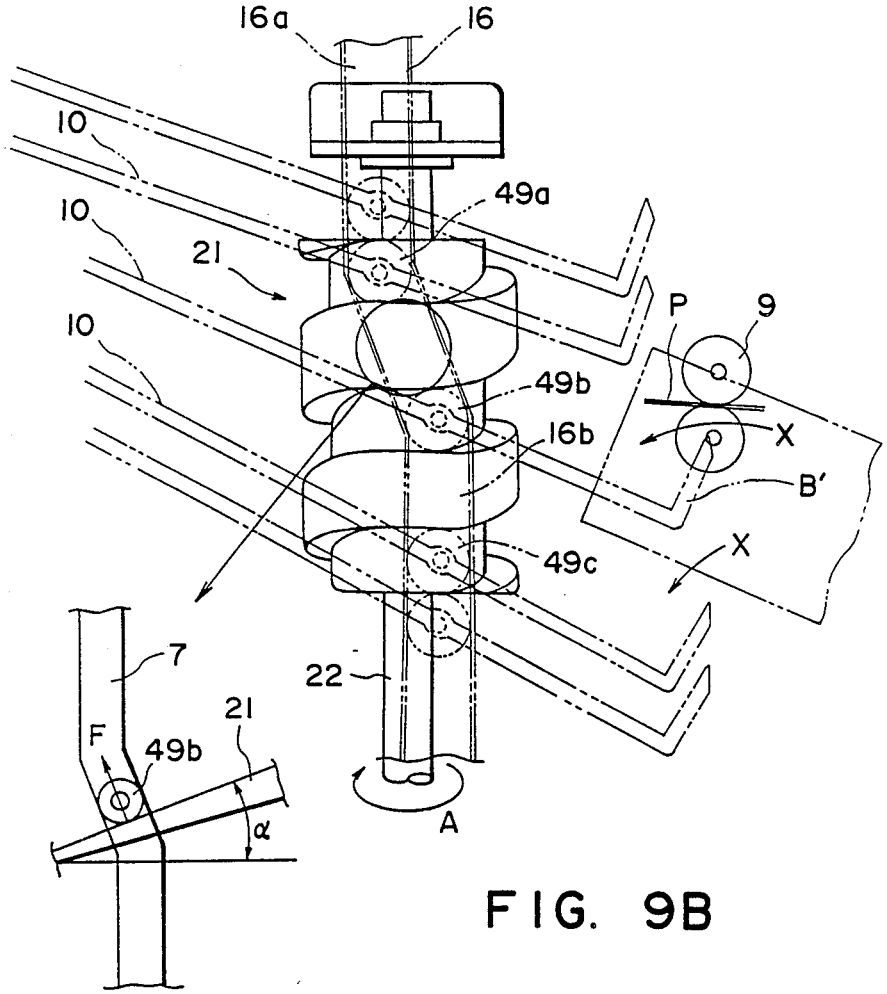

The guide rail 16' is provided on each of the front and rear side plates 3, and has a configuration, as shown in FIGS. 8, 9A and 9B, extending from the bottom to the top. The guide rail 16' is bent away from the lower discharging roller couple 9 toward the top at the position opposed to the lead cams 21 and 21. When the trunnion 49 is introduced along the guide rail 16', the bin 10 is moved along the lower portion **16*b* of the guide rail 16' adjacent to the lower discharging roller couple 9 to receive the sheet P discharged by the lower discharging roller couple 9 without a part of the sheet P carried on the base end side stopper 10*c*, and then, after the sheet is received, the bin 10 moves away from the lower discharging roller couple 9 along the bent portion of the guide rail 16' to the upper portion 16*a* of the guide rail 16'. Therefore, the accommodated sheet P is not interfered with the lower discharging roller couple 9**.

Figure 10:
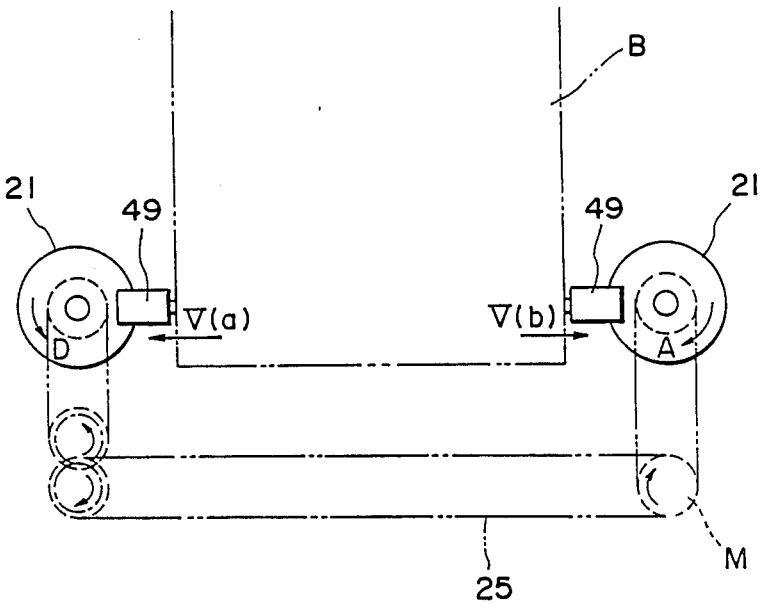
FIG. 10 illustrates driving of the lead cam.

As shown in FIGS. 9A and 9B, the lead cams 21 and 21 has different or opposite helical directions between the front side lead cam 21 and the rear side lead cam 21, so that the driving directions are opposite, as shown in FIG. 10.

In addition, the lead cams 21 and 21 are so configured that two of the expanded spaces X are simultaneously formed. The sheet discharged by the lower discharging roller couple 9 is discharged and received by the bin 10 opposed to the lower discharging roller couple 9 through the upper expanded space X. Since the two expanded spaces X are simultaneously formed, a head **60*a* and an anvil 60*b* of the electric stapler unit 60 can be inserted without unnecessary interference with the sheet when the electric stapler unit 60 reaches to the bin 10 (FIG. 8**).

As described, according to this embodiment, the guiding means is constructed such that one of the untransported portion or the transported portion of the trunnion is shifted relative to the other in the direction downstream of the sheet discharge at a position opposed to the helical cam means, by which when the bin receives the sheet, the bin approaches the sheet discharging means, and after the sheet is received, the bin displaces downstream with respect to the sheet discharge direction to avoid interference with the sheet discharging means, whereby the sheet is prevented from remaining on the trailing edge stopper of the bin or from being jammed.

Additionally, the head of the stapler can be disposed at a position of the guide shift, so that the head is prevented from interference with the base portion of the bin, so that the stapler can be added to the sheet sorter without difficulty.

Furthermore, the helical cam means for transporting the trunnions includes a couple of helical cam members having different helical directions, and the helical cam members are rotated in the opposite directions. So that the load of the guiding member by the force received by the trunnion from the helical cam members is reduced, so that the trunnion is guided smoothly by the shifted guiding member, and therefore, the motor for driving the helical cam means does not require a large force without obstructing the smooth movement of the bin. Therefore, the sheet sorter can be operated with less noise and with good alignment performance.

Next, the description will be made as to the details of the stapler.

Figure 11:
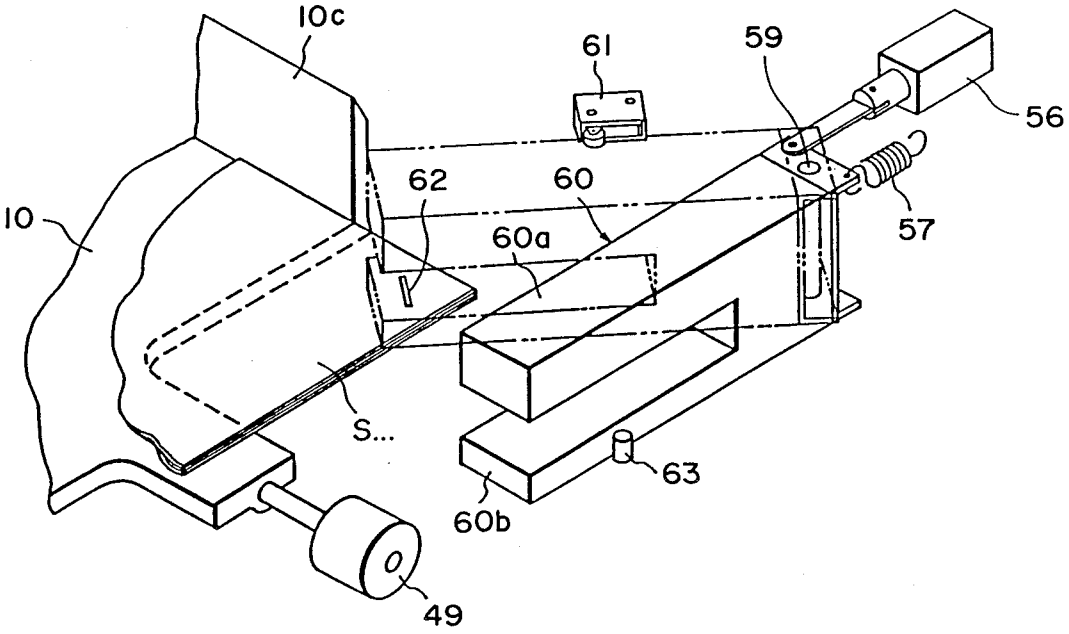
FIG. 11 is a perspective view of a stapler.

Faced to the lower discharging roller couple 9, there is an electric stapler 60 for stapling the sheets accommodated on the bin 10. As shown in FIG. 11, the electric stapler 60 has a solenoid 56 and a stapler spring 57. The electric stapler 60 is swingable about a pivot 59. And is normally abutted to the stopper 63 to be located at a retracted position retracted from the sheet passage (solid line position). When, however, the stapling operation is to be performed, it is moved to the chain line position to staple the sheets S accommodated on the bin 10 disposed opposed to the lower discharging roller couple 9. Designated by a reference numeral 61 in FIG. 11 is a microswitch to detect the electric stapler 60 moved to a sheet stapling position.

When the stapling mode is selected, the solenoid 56 is energized in response to a staple starting signal, and the electric stapler is pulled by the solenoid 56 to be rotated about the pivot 59, thus moving to the stapling position indicated by chain lines.

Figure 14:
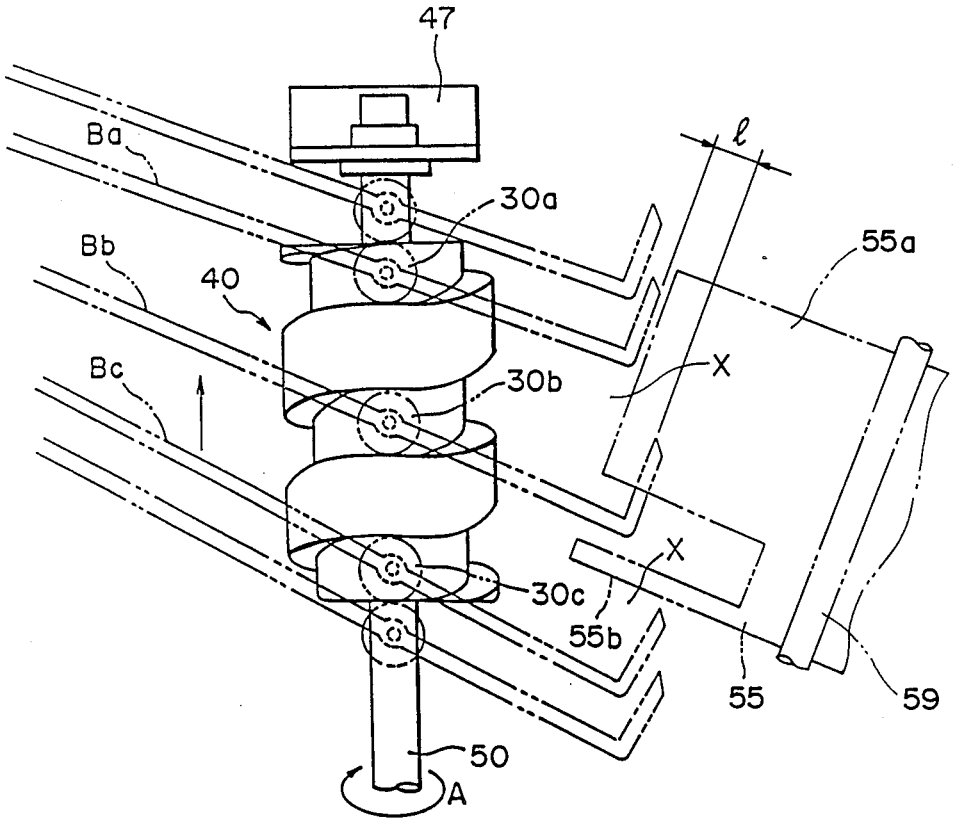
FIG. 14 is a side view illustrating a relationship between the stapler and the bins of FIG. 11 stapler.

At this time, the head **60*a* of the electric stapler 60 moves to the stapling position through the upper expanded space formed between the bin 10 accommodating the sheets to be stapled and the upper adjacent bin 10, as shown in FIG. 14, for example. On the other hand, the anvil 60*b*** is moved to the stapling position through the lower expanded space.

When the electric stapler 60 moves to the stapling position, the microswitch 61 is actuated, in response to which staple permitting signal is produced, so that the electric stapler 60 is driven, and the sheets S are stapled by a staple 62.

After the staple 62 is shot, the solenoid 56 is deenergized, so that the electric stapler 60 is returned to the stopper 63 by the stapler spring 57. This is the end of a stapling operation for one bin.

As for the stapling operations for plural bins 10, it is most efficient if the stapling operation starts with the bin 10 to which the last sheet is discharged and accommodated. In this case, the series of operations of the electric stapler 64 are performed in response to a bin shift completion signal, and the next bin shift operation is performed in response to the completion signal of the series of the electric stapler 60 operation. By repeating these operations, the automatic stapling operation is completed. The number bin shifting operations is the same as the number of bin shift operations during the sorting operation.

In this embodiment, since two expanded spaces X and X are formed at a position opposed to the electric stapler 60, the head 60*a* of the electric stapler 60 and the anvil 60*b* thereof are moved to the simultaneously, the stapler does not interfere with the sheets S accommodated in the lower bin 10, so that sheets can be assuredly stapled.

In this embodiment, the alignment rod 42 and the electric stapler 60 are rotated about a respective shaft, but it may make a rectilinear movement.

Figure 12:
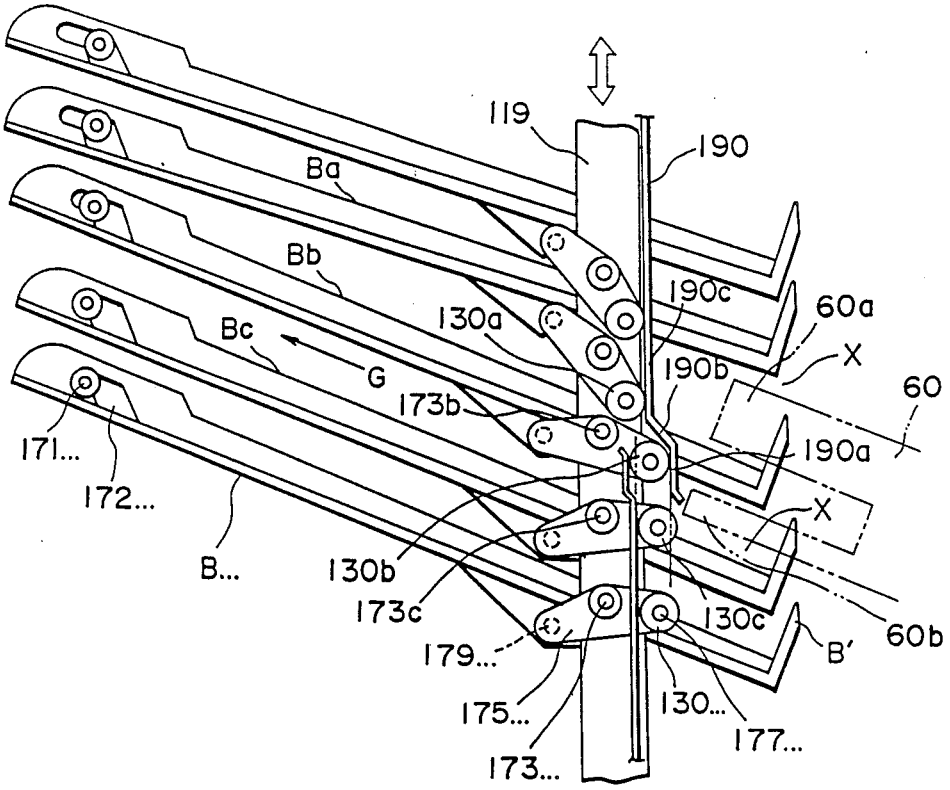
FIG. 12 is a side view of a major part of a sorter according to a further embodiment of the present invention.

Referring to FIG. 12, a further embodiment will be described, wherein the structure for providing the expanded portions or spaces X and X is different.

An elongated slot 172 is formed in each of the bins B which is slidably engaged with an end side shaft 171 fixed to the bin slider 27 of the bin unit 1. An arm lever 175 is rotatably mounted on each of base side shafts 173 securedly fixed to the bin frame 119. At one end of the arm lever 175, a trunnion 130 is rotatably mounted by a pin 177. At the other end of the arm lever 175, a pin 179 is mounted, which pin is engaged with a whole of the bin B. By this structure, the bin B is swingably supported on the arm lever 175. The bin B is inclined toward the base side (toward the trailing edge stopper B'), so that it moved downwardly by its weight.

A stationary cam plate 190 is fixedly mounted to each of the side plates of the sorter to guide the trunnions 130.

When the bin frame 119 moves upwardly, the trunnions 130 together with the bins B move upwardly while being in contact with the cam plate 190.

First, the trunnion 130*b* of the second bin Bb contacted to a first cam surface 190*a* of the cam plate 190 rotates downwardly about the pin 173*b*, so that the bin Bb moves substantially parallel to a direction indicated by a reference G to provide expanded space between the lower third bin Bc.

On the other hand, as to the first bin Ba above the second bin Bb, the trunnion 130*b* thereof moves along the tapered surface 190*b* of the cam plate 190 to be brought into contact with the second cam surface 190*c* thus forming an expanded space X with the lower second bin Bb. As a result, two expanded spaces are formed. When the bins B are moved downwardly, to spaces X and X are formed similarly.

Figure 13:
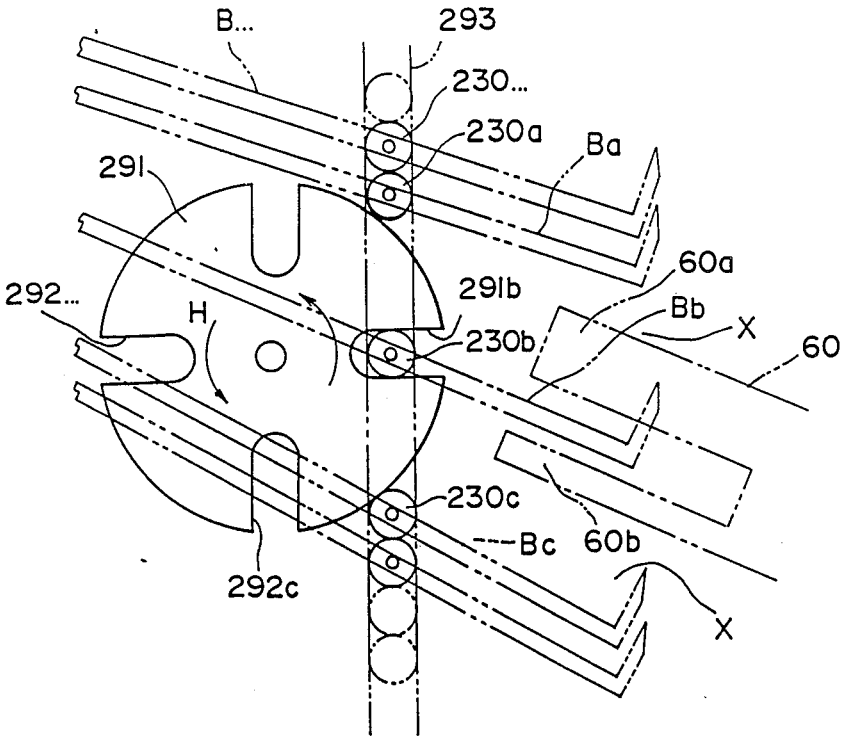
FIG. 13 is a side view of an major part of a sorter according to a further embodiment.

Referring to FIG. 13, another embodiment taking another form of the expanding structure.

In this embodiment, the use is made with a Geneva pulley 391 having slots 292 engageable with the trunnions 230 of the bins B to form two expanded spaces between bins, simultaneously.

The pulley 291 has four engaging slots 292 engageable with trunnions 230. When the pulley 291 rotates in the direction H, a trunnion 230 of a bin Bc, for example, is engaged with a slit 292*c* of the pulley 291, and it moves upwardly along the guiding slot 293 by the rotation of the pulley 291 to a position indicated by a reference 230*b*, where it is stopped. The trunnion 230*b* of the upper bin Bb placed at the position 230*b* is moved upwardly to the upper position 230*a*. In this manner, expanded spaces X and X are formed between the intermediate bin Bb and the upper bin Ba, and between the intermediate bin Bb and the lower bin Bc.

During the lowering movement of the bin B, two expanded spaces are formed.

The trunnions 330 are rotatably mounted to the respective bins B and are stacked in the guiding slot 293. The bottommost trunnion 230 is urged upwardly by the spring.

While the invention has been described with reference to the structures disclosed herein, it is not confined to the details set forth and this application is intended to cover such modifications or changes as may come within the purposes of the improvements or the scope of the following claims.

What is claimed is:

1. A method of controlling a sheet sorter wherein said sheet sorter includes a plurality of bins for accommodating sheets, the bins being arranged in a vertical direction, a first sheet discharging means for discharging sheets not to be sorted, second sheet discharging means, disposed with a vertical interval from the first sheet discharging means, for discharging sheets to be sorted, bin moving means for moving substantially vertically the bins and stapler means for stapling the sheets, said method comprising:

providing said stapler means adjacent to the second sheet discharging means;

accommodating the sheets on the plurality of bins by sequentially opposing the bins to said second sheet discharging means, and stapling the sheets on the bins by the stapler, when a sorting mode and a stapling mode are selected;

discharging the sheets by said first discharging means and accommodating them on a said bin when a non-sorting mode and non-stapling mode are selected; and discharging the sheet by said second discharging means and accommodating them on a said bin, and stapling them, when the non-sorting mode and the stapling mode is selected.

2. A method according to claim 1, wherein when the sorting mode is selected, the bins having received the sheets are sequentially moved to sequentially oppose to the stapler.

3. A method according to claim 2, further comprising providing aligning means actable on all of the bins, and it aligns the sheet each time it is discharged on a bin.

4. A method according to claim 1, wherein the bin opposed to the second sheet discharging means when the non-sorting mode and the stapling mode are selected is a bin for receiving the non-sorted sheets.

5. A method according to claim 1, wherein the bin opposed to the second sheet discharging means when the non-starting mode and the stapling mode are selected is one of the bins for receiving the sorted sheets.

* * * * *

UNITED STATES PATENT AND TRADEMARK OFFICE

CERTIFICATE OF CORRECTION

PATENT NO. : 4,930,761

DATED : June 5, 1990

INVENTOR(S) : Masataka Naito et al.

It is certified that error appears in the above-identified patent and that said Letters Patent is hereby corrected as shown below:

ON TITLE PAGE:

[56] REFERENCES CITED

U.S. PATENT DOCUMENT

Change "Ushiragata" to --Ushirogata--; and

Change "4,983,550 4/1978 Pal" to --4,083,550 4/1978 Pal--.

[56] REFERENCES CITED

FOREIGN PATENT DOCUMENT

Change "009925 12/1985 European Pat. Off.." to --0099250 12/1985 European Pat. Off..--.

[52] ABSTRACT

Line 12, change "of sequentially" to --by sequentially--; and

Line 19, change "sheet" to --sheets--.

COLUMN 3

Line 45, change "arm 39" to --arm 37--;

Line 56, change "supporting pin 47" to --supporting pins 47--; and

Line 58, change "supporting bins 47." to --supporting pins 47.--

UNITED STATES PATENT AND TRADEMARK OFFICE

CERTIFICATE OF CORRECTION

PATENT NO. : 4,930,761

DATED : June 5, 1990

INVENTOR(S) : Masataka Naito et al.

It is certified that error appears in the above-identified patent and that said Letters Patent is hereby corrected as shown below:

COLUMN 5

Line 50, change "driving motor 67" to --driving motor 17--; and

Line 55, change "first sensor 61" to --first sensor 62--;

COLUMN 6

Line 65, change "stapled." to --being stapled--.

COLUMN 8

Line 24, change "pivot 59. And" to --pivot 59, and--; and

Line 59, change "electric stapler 64" to --electric stapler 60--.

UNITED STATES PATENT AND TRADEMARK OFFICE

CERTIFICATE OF CORRECTION

PATENT NO. : 4,930,761

DATED : June 5, 1990

INVENTOR(S) : Masataka Naito et al.

It is certified that error appears in the above-identified patent and that said Letters Patent is hereby corrected as shown below:

COLUMN 9

Line 2, change "the simultaneously," to --the stapling portion without difficulty when the electric stapler 60 performs its stapling operation, and simultaneously,--;

Line 19, change "whole" to --hole--; and

Line 47, change pulley 391" to --pulley 291--.

COLUMN 10

Line 6, change "trunnions 330" to --trunnions 230--; and

Line 56, change "non-starting mode" to --non-sorting mode--.

Signed and Sealed this

Fourth Day of August, 1992

*Attest:*

DOUGLAS B. COMER

*Attesting Officer*

*Acting Commissioner of Patents and Trademarks*